United States Patent [19]

McLaughlin

[11] 4,225,120

[45] Sep. 30, 1980

[54] MULTI-SECTION FENCE

[76] Inventor: Robert M. McLaughlin, 1 Mellin St., Burlington, Mass. 01803

[21] Appl. No.: 34,964

[22] Filed: May 1, 1979

[51] Int. Cl.[2] ..... E04H 17/16

[52] U.S. Cl. ..... 256/24; 256/73; 256/23; 256/65

[58] Field of Search ..... 256/24, 25, 27, 31, 256/65, 70, 72, 66, 19, 73, 23

[56] References Cited

U.S. PATENT DOCUMENTS

| | | | |
|---|---|---|---|
| 1,070,814 | 8/1913 | Kimball | 256/65 UX |
| 3,193,255 | 7/1965 | Burdett | 256/19 |
| 3,448,257 | 6/1969 | Sackett, Jr. | 256/24 X |
| 3,454,262 | 7/1969 | Romano | 256/24 X |
| 3,462,126 | 8/1969 | Demanega | 256/65 |
| 3,648,981 | 3/1972 | Allen | 256/24 |
| 3,933,311 | 1/1976 | Lemelson | 256/24 X |
| 3,955,801 | 5/1976 | Soriero, Jr. | 256/65 |
| 4,063,714 | 12/1977 | Kirkwood | 256/24 |
| 4,072,294 | 2/1978 | Densen | 256/24 |

*Primary Examiner*—Andrew V. Kundrat

*Attorney, Agent, or Firm*—Shoemaker and Mattare, Ltd.

[57] ABSTRACT

A multi-section fence wherein the sections are easily assembled by a single unskilled worker without the need of special tools. Each of the sections includes rails, and a plurality of frame members are attached to the rails and each frame member includes a multi-perforated panel. Fence posts have anchors which are positioned so that uneven terrain is easily accommodated.

11 Claims, 9 Drawing Figures

MULTI-SECTION FENCE

BACKGROUND OF THE INVENTION

The present invention relates in general to fences, and, more particularly, to modular fences.

Fences have been used for many years to demark land boundaries, to enclose areas, as decorations, for privacy, and the like. Accordingly, there are many forms of fences available. Examples of such fences are found in U.S. Pat. Nos. 3,193,255, 3,454,262, 3,648,981, 3,933,311, 4,063,714 and many other disclosures. While these known structures are quite useful, they have several drawbacks which prevent the use thereof under a wide variety of conditions. For example, those fences which utilize panels may be susceptible to being damaged by high winds, and those fences which do not include panels may be easily climbed and thereby breached.

A further drawback to many known fences is the difficulty associated with the setting up of such fences. This setup difficulty is especially important in those known fences having highly decorative features. Such fences often require skilled workmen to perform the setup, thereby increasing the cost of such fences.

Yet another drawback to known fences is the difficulty of setting up such fences on uneven terrain. The known panel-type fences are especially difficult to set up upon uneven terrain.

SUMMARY OF THE INVENTION

The fence embodying the teachings of the present invention is easily set up, yet has considerable aesthetic appeal.

The fence includes a plurality of sections. Each section is defined by a pair of posts, and a pair of vertically spaced horizontal rails extend between the posts to define the top and bottom of the fence panel sections. A plurality of multi-perforated panels are mounted in frames and are attached to the rails by locking pin means and mortise and tenon means. Top caps are placed on the posts. The locking pin means can include means for making those pins tamper-proof after installation thereof.

The posts have anchor means thereon, and these anchor means are spaced apart and located to accommodate vertically staggered fence sections. Such offsetting of fence sections permits a fence to be set up on uneven terrain.

Each of the panels has a multiplicity of multi-sized holes defined therethrough. The holes provide aesthetic effects, yet are placed and sized so that the fence is virtually non-climbable. Air passes through the holes so that the fence will not be susceptible to being knocked over by a high wind.

Assembly of a fence from a plurality of fence sections, even on uneven terrain, does not require any special skills or tools, and can thus be effected by a person who is unskilled and does not own any special tools. There is not even any need for a second person, as the assembly of the fence sections can be easily performed by a person who is working alone.

The components of the fence embodying the teachings of the present invention are preferably fabricated out of materials, such as polyvinyl chloride, or the like, and are thus not susceptible to rotting or other such deterioration and require no paint, maintenance, or the like.

OBJECTS OF THE INVENTION

It is, therefore, a main object of the present invention to provide a fence which, after post holes are prepared, can be assembled by an unskilled person without the use of any special tools.

It is another object of the present invention to provide a fence which can easily accommodate uneven terrain.

It is yet another object of the present invention to provide a fence which is comprised of a plurality of panels, yet which is not susceptible to wind damage.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
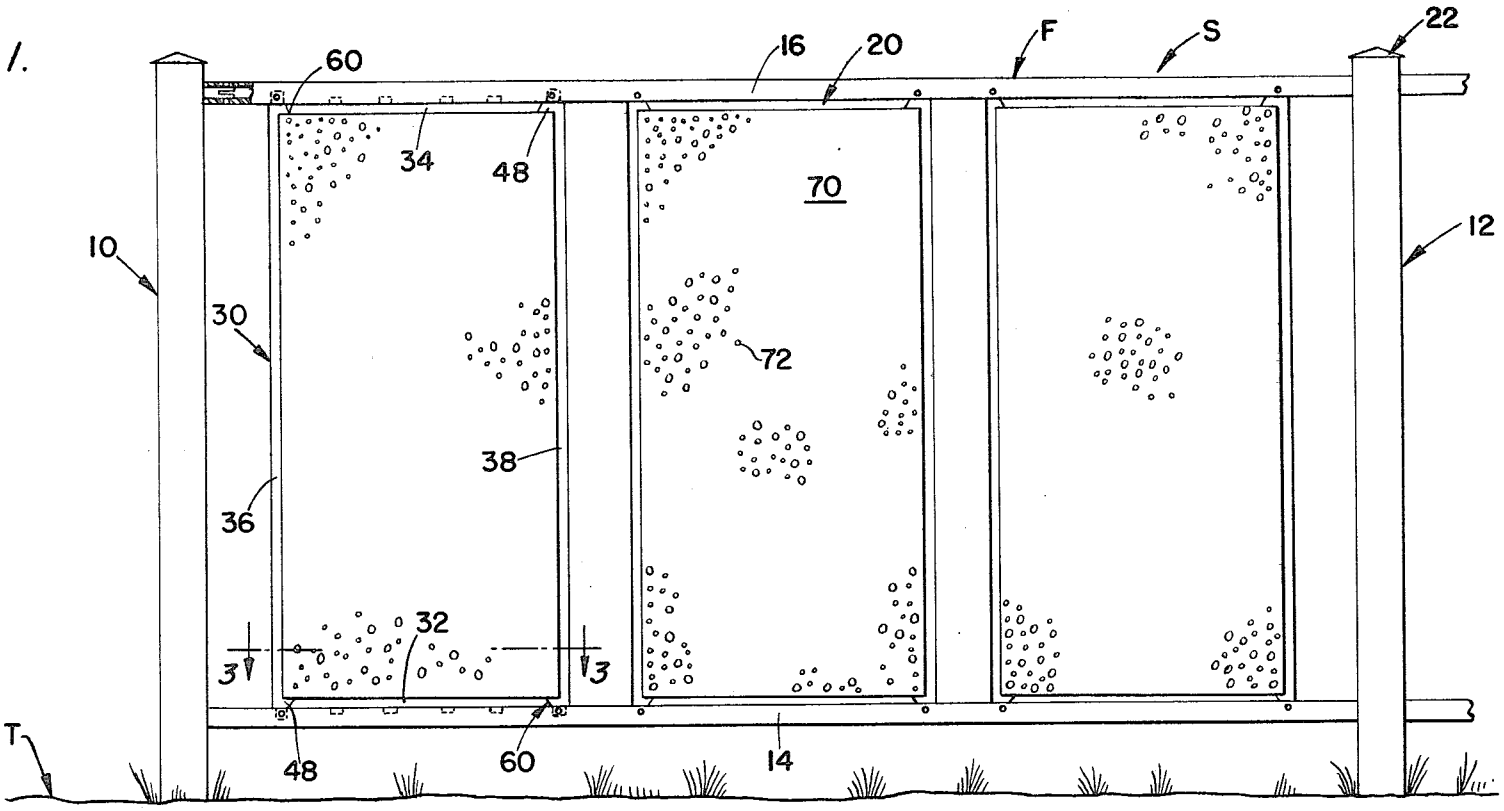
FIG. 1 is an elevation view showing a fence section embodying the teachings of the present invention.
Figure 5:
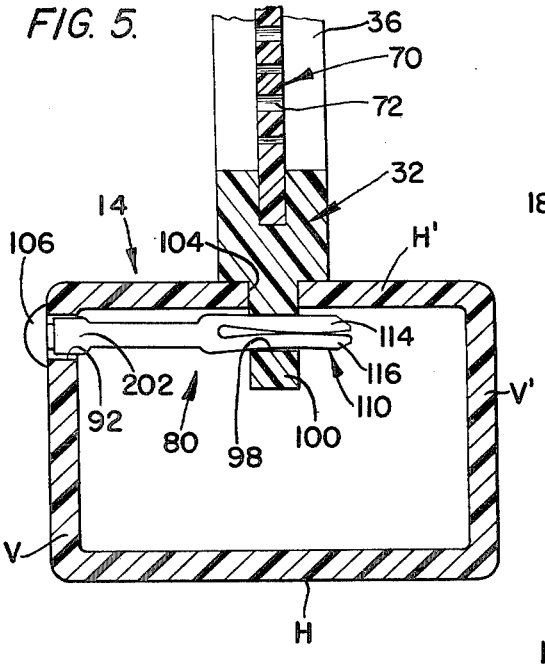
FIG. 5 is a view taken along line 5—5 of FIG. 4.

Shown in FIG. 1 is a section S of a fence F embodying the teachings of the present invention. The section S shown in FIG. 1 is defined by a starter post 10 and a standard post 12 embedded in any chosen terrain T to be upstanding in the usual manner. The section S further includes a horizontal bottom rail 14 and a horizontal top rail 16 attached to the posts to be vertically spaced from each other and to span the section S. The rails are preferably rectangular in cross-section and are best shown in FIG. 5 to include a pair of vertical walls V and V′ and a pair of horizontal walls H and H′. The rails and posts are preferably hollow, and the posts are preferably square in transverse cross-section. The section S further includes a plurality of rectangular panel members 20 attached to the rails with the long dimension thereof vertically disposed and the width dimension thereof located in the plane which is parallel to or in a plane containing the posts 10 and 12. The posts are topped by post caps 22, and the preferred form of the invention includes three panel members per section, however, more or less panel members can be used without departing from the scope of the present disclosure.

Figure 2:
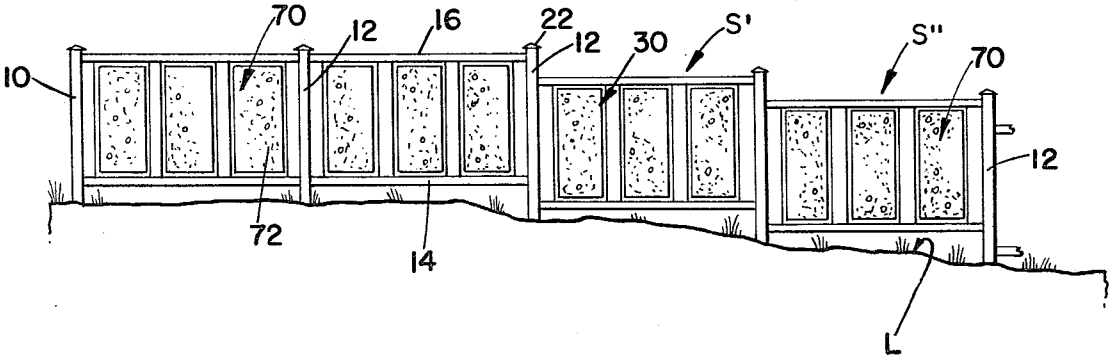
FIG. 2 is an elevation view showing a fence embodying the teachings of the present invention set up on uneven terrain.

As shown in FIG. 2, a plurality of fence sections S can be interconnected via standard posts 12 to define a fence, and the sections can be attached to the posts in an offset manner to accommodate uneven terrain.

Figure 9:
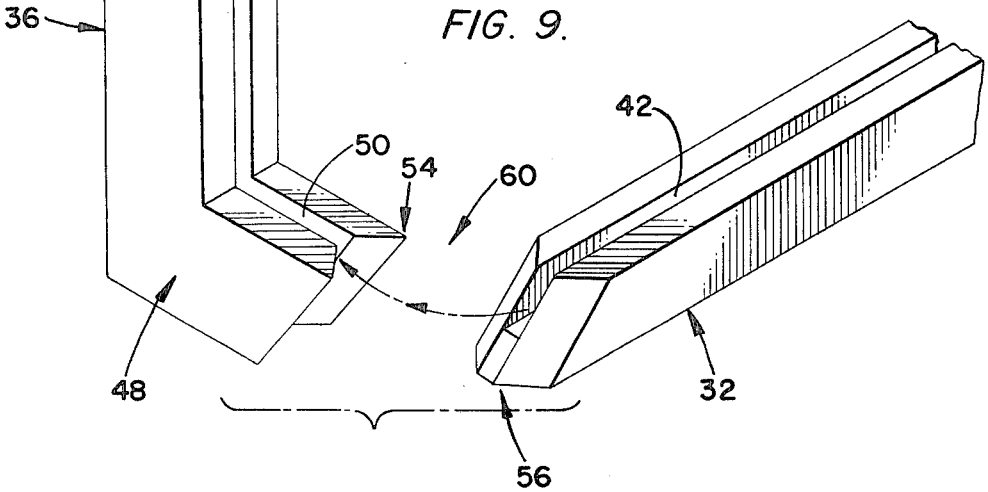
FIG. 9 is an exploded perspective of a portion of a frame member used in the fence embodying the teachings of the present invention.

Each panel member includes a frame 30 defined by a pair of horizontal frame sections 32 and 34 and a pair of vertical frame sections 36 and 38. The frame sections are best shown in FIG. 9 to be longitudinally grooved with slots 42 and 44 in the horizontal and vertical frame sections, respectively. As shown in FIG. 9, the vertical frame section includes a corner section 48 extending outwardly therefrom at a right angle and having a slot 50 defined therein to mate with the vertical slot 44 and horizontal section slot 42. The corner section has an outer end 54, and the horizontal frame member 32 has a corresponding end 56. The two ends 54 and 56 are mitered to form miter joint 60 as indicated in FIG. 9 and shown in FIG. 4. The top frame section is formed similarly with the corner section being on the vertical frame section as indicated in FIG. 1 where a miter joint 60 is shown on a top frame section.

A multi-perforated panel 70 is retained within the frame 30 and includes a plurality of holes 72. The holes define a path for air to flow through the panel, thereby making the fence composed of the panels 70 resistant to wind damage. The holes may be of various sizes such as indicated in FIG. 4 by the reference numerals 72', 72'' and 72''', and also serve a decorative purpose and allow light to pass through the fence. The holes are sized and located to prevent climbing of the fence, thereby permitting the fence to serve as a boundary demarcation. The holes are also shown in FIGS. 3 and 4.

Figure 3:
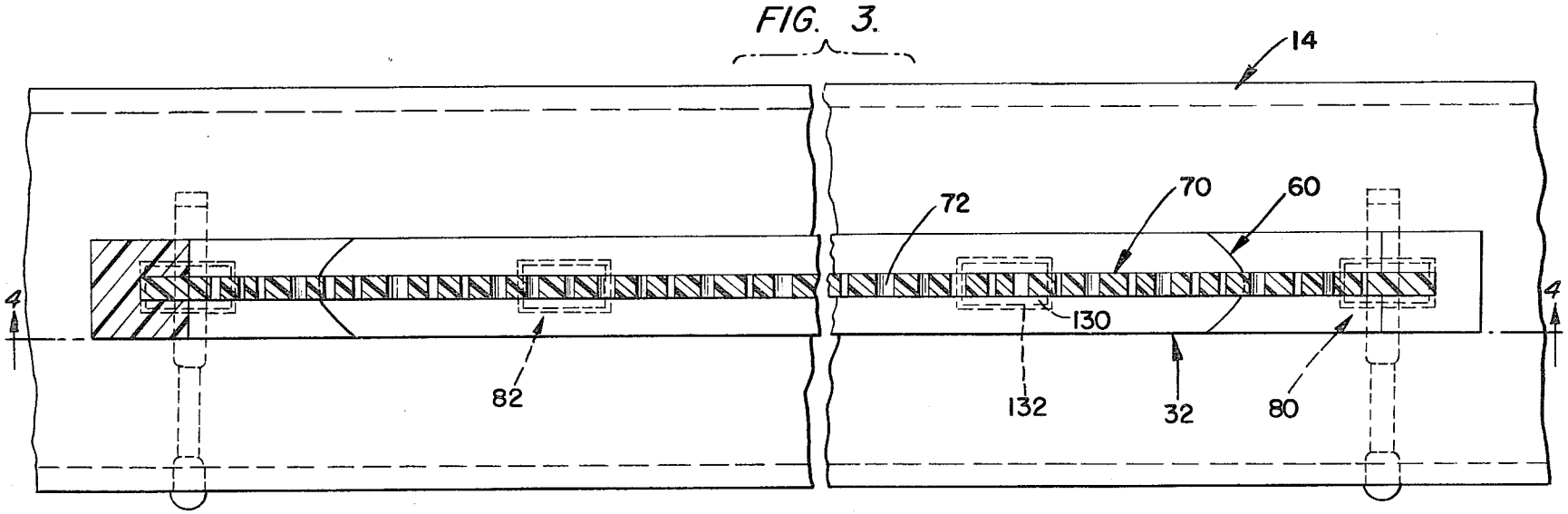
FIG. 3 is a view taken along line 3—3 of FIG. 1.
Figure 4:
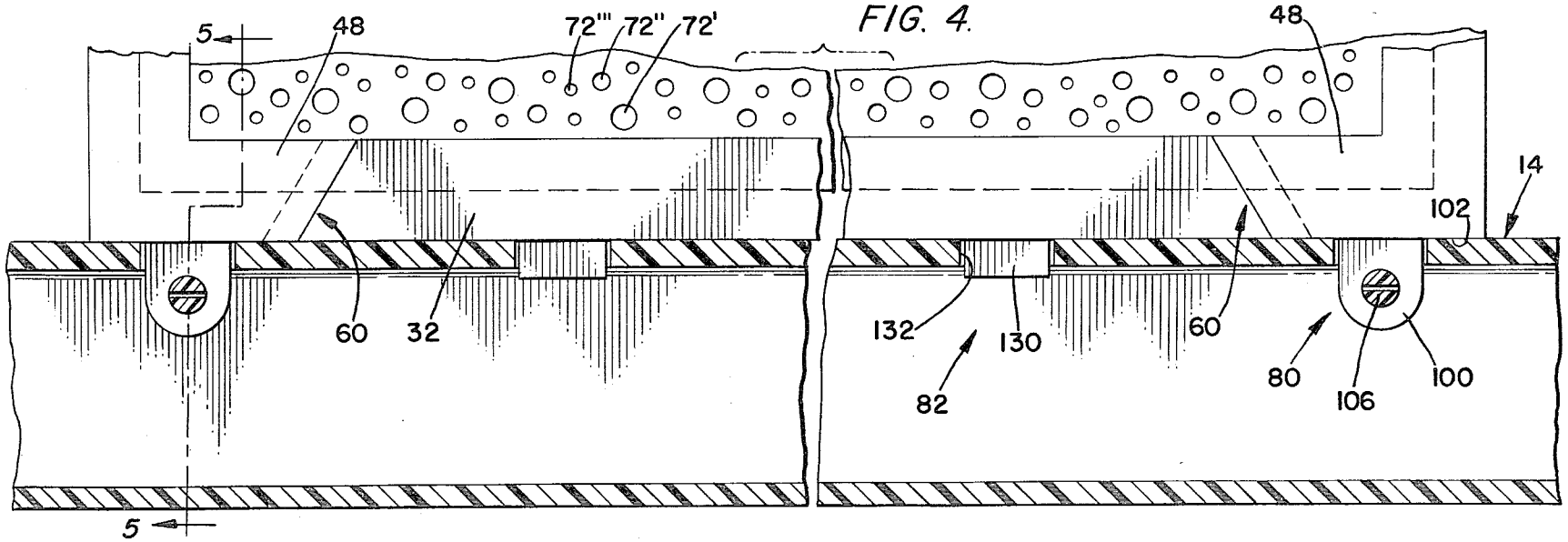
FIG. 4 is a view taken along line 4—4 of FIG. 3.
Figure 6:
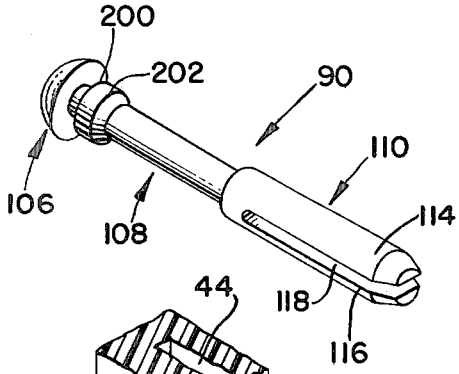
FIG. 6 is a perspective of a locking pin used in the fence embodying the teachings of the present invention.

As best shown in FIGS. 3–5, the horizontal rails 14 and 16 are hollow, and the panel members are mounted on the horizontal rails 14 and 16 by pin locking means 80, and mortise and tenon means 82. The pin locking means is shown in FIGS. 5 and 6 to include a spring-type locking pin 90 which fits through a locking pin hole 92 defined in a vertical side of the rail and through receiving hole 98 which is defined in lug 100 to be aligned with the locking pin hole 92. The lug 100 is integrally attached to bottom 102 of the frame corner section 48, and extends through a hole 104 defined in the rail horizontal top wall H'. As shown in FIG. 6, the locking pin 90 is a round head type with a slotted head section 106 mounted on one end of a shank 108 and a spring-tight bifurcated jam section 110 on an opposite end of the shank 108. The jam section 110 includes a pair of legs 114 and 116 each attached at one end thereof to the shank, and free at the other end thereof to define a gap 118 therebetween. The jam section is forced through the lug hole 98 which is sized to force the two legs 114 and 116 together. As indicated in FIG. 5, the locking pin 90 is sized to fit easily through the hole 92, but to be jammed through hole 98 and trapped thereby. The head 106 is sized to abut the wall 94 adjacent the hole 92 and thereby attach the panel frame to the rail. As indicated in FIG. 1, there are pin locking means associated with each frame corner section. The mortise and tenon means 82 are located at spaced locations along the horizontal rails and each includes a lug or tenon 130 integrally mounted on the frame horizontal member to depend therefrom and a hole or mortise 132 defined in the horizontal rail to receive the tenon. The elements attach the frame member to the rails, and align these elements. As indicated in FIG. 1, there are a plurality of mortise and tenon means on both the top and bottom of the panels.

Figure 7:
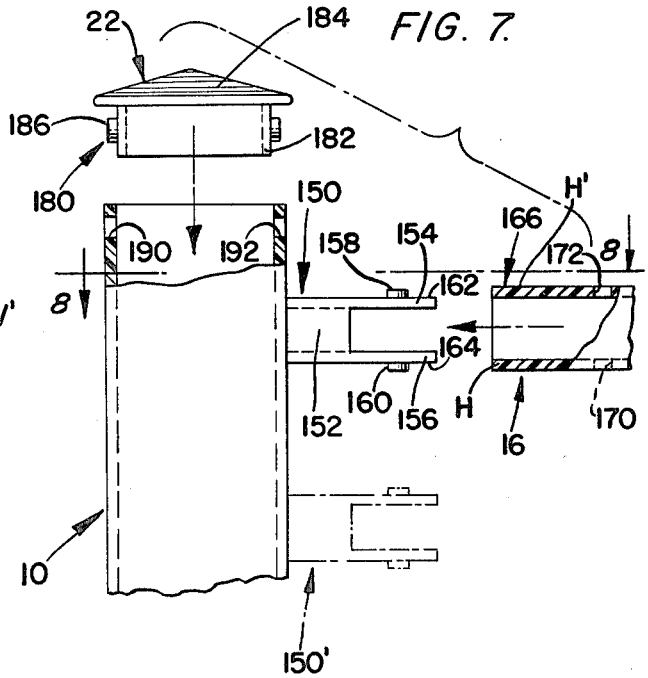
FIG. 7 is an exploded view of a post used in the fence embodying the teachings of the present invention.
Figure 8:
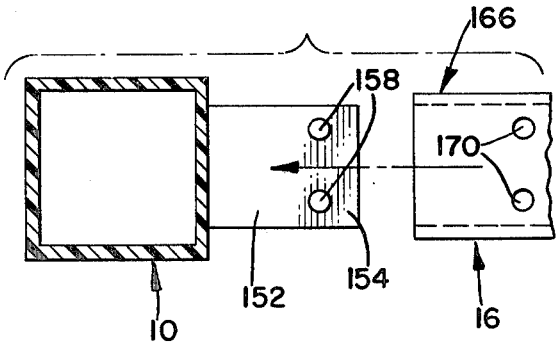
FIG. 8 is a view taken along line 8—8 of FIG. 7.

As shown in FIGS. 7 and 8, the posts have rail anchoring means 150 integrally attached thereto extending horizontally therefrom. The anchoring means 150 each includes a base 152 mounted on the posts, and a pair of horizontally extending and vertically spaced apart prongs 154 and 156. Pairs of detents 158 and 160 are mounted on the outer surfaces 162 and 164 of the prongs 154 and 156, respectively, to be presented in a vertical direction.

As discussed above, the rails are hollow, and the ends 166 thereof are open as best shown in FIG. 7. A pair of detent receiving holes 170 and 172 are defined in horizontal walls H and H' of the rail members at locations to receive the detents 158 and 160, respectively, and to thereby capture the anchor means to attach the rail to the post. The legs 154 and 156 are spaced to fit into the hollow rail snugly enough to ensure a secure attachment between the rail and the anchor means, yet an attachment that is not overly difficult to effect.

An offset anchoring means 150' can be included on a post, or a separate post may have anchor means offset from anchor means 150, and, as indicated in FIG. 7, the anchor means can be located at several different locations on a post. This feature allows the fence to be set up on uneven terrain by permitting the offsetting of one fence section with respect to an adjacent fence section as indicated in FIG. 2 for sections S' and S'' which are offset from the other fence sections and from each other to accommodate hill L in the terrain. Thus, posts with the anchors placed at various locations are used if the terrain is uneven.

The top cap 22 is retained on the post by a detent means 180 which includes a peripheral skirt 182 depending from the cap roof 184 and a pair of detent projections 186 extending outward of the square cap which is the preferred transverse cross-sectional shape of the post and the cap C. A pair of detent receiving holes 190 and 192 are defined in the post to accommodate the projections 186 and thereby lock the cap to the post. The skirt 182 is sized to fit into the post snugly enough to securely hold the cap on the post, but not so snugly as to prevent expeditious placement of the cap onto the post by an unskilled person.

In the preferred embodiment, the sections S are 8 feet long and have three 2 by 4 foot panels each. The panels can be in a variety of colors. The preferred form of the rails has a 3 inch by 2 inch dimension, and the fence posts are preferably 8 feet long, and can be square with dimensions of 4 inches by 4 inches if desired (in which case, the cap C will also be square). In one embodiment, there are twelve locking pins per 8 foot section.

Assembly of a fence is easily effected using a plurality of sections S. All of the components that are used in the fence can be manufactured in a plant, and assembled at the site of the fence. The fence components can be shipped in packing materials designed for use as a fixture by which the final assembly of the parts can be accomplished with great ease. While a level may be helpful, no special tools are required to carry out assembly of this fence.

As is best shown in FIG. 6, the fastener 90 can include a slot 200 defined in boss 202 adjacent the head 106. The slot 200 permits removal of the head 106 if desired. It is noted that it may be desirable for the locking pin to fit flushly with the surface of the rail. Thus, once the pin is in place, the head 106 can be removed. Once the head is removed, the fastener is tamper-proof.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A multi-section fence with each section comprising:

a pair of fence posts;

a pair of hollow vertically spaced horizontal rails connected to said posts and each having a plurality of locking pin holes defined therein and a plurality of lug receiving holes defined therein;

a plurality of panel members, each including a multi-perforated panel and a panel frame, said panel frame including a pair of vertical frame members and a pair of horizontal frame members;

panel member connecting means connecting each of said panel members to said rails and including a lug on said panel frame, said lug extending into the interior of one of said rails through one of said lug receiving holes and having a locking pin receiving hole defined therethrough which is aligned with one of said rail locking pin holes, a plurality of locking pins each extending through said aligned rail and lug locking pin receiving holes, said locking pin having a bifurcated tip which is snugly received in said lug locking pin receiving hole, and a plurality of second lugs on said panel member received in a plurality of second holes defined in said rails.

2. A multi-section fence as defined in claim 1 further including anchor means on said posts for connecting said rails to said posts, said anchor means each including a base attached to a post, a pair of vertically spaced apart prongs, a detent projection on at least one of said prongs, and a detent receiving hole on one of said rails for receiving said detent projection.

3. A multi-section fence as defined in claim 1 further including a cap mounted on each of said posts.

4. A multi-section fence as defined in claim 1 wherein said horizontal and vertical frame members are elongate and are longitudinally slotted.

5. A multi-section fence as defined in claim 4 wherein said vertical frame members each includes a corner section extending outwardly at a right angle from said vertical frame section.

6. A multi-section fence as defined in claim 2 wherein anchoring means on one post are offset from anchoring means on an adjacent post so the fence can be set up on uneven terrain.

7. A multi-section fence as defined in claim 1 wherein said rails are hollow.

8. A multi-section fence as defined in claim 7 wherein said posts are hollow.

9. A multi-section fence as defined in claim 3 wherein said cap includes a roof, a skirt depending from said roof, and a detent projection on said skirt, and wherein said posts further include cap detent receiving holes defined therein.

10. A multi-section fence as defined in claim 7 wherein said rails are rectangular in transverse cross-section.

11. A multi-section fence as defined in claim 1 wherein said locking pins include body sections and head sections on said body sections, and means for removing said head sections from said body sections.

* * * * *